US012571581B2

(12) United States Patent
Kwon et al.

(10) Patent No.: US 12,571,581 B2
(45) Date of Patent: Mar. 10, 2026

(54) REFRIGERATOR

(71) Applicant: SAMSUNG ELECTRONICS CO., LTD., Suwon-si (KR)

(72) Inventors: Juno Kwon, Suwon-si (KR); Sangmin Park, Suwon-si (KR); Hyekyoung An, Suwon-si (KR); Seokjun Yoon, Suwon-si (KR); Jin Jeong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 305 days.

(21) Appl. No.: 17/990,834

(22) Filed: Nov. 21, 2022

(65) Prior Publication Data

US 2023/0083329 A1 Mar. 16, 2023

Related U.S. Application Data

(63) Continuation of application No. PCT/KR2021/005125, filed on Apr. 22, 2021.

(30) Foreign Application Priority Data

Jun. 19, 2020 (KR) ..... 10-2020-0075028

(51) Int. Cl.
*F25D 23/04* (2006.01)
*F25D 23/02* (2006.01)

(52) U.S. Cl.
CPC ..... *F25D 23/04* (2013.01); *F25D 23/028* (2013.01); *F25D 2323/021* (2013.01); *F25D 2323/122* (2013.01); *F25D 2331/806* (2013.01)

(58) Field of Classification Search
CPC .. F25D 23/04; F25D 23/028; F25D 2323/021; F25D 2323/122; F25D 2331/806
See application file for complete search history.

(56) References Cited

U.S. PATENT DOCUMENTS

| | | | | |
|---|---|---|---|---|
| 6,574,984 | B1 | 6/2003 | McCrea et al. | |
| 8,544,291 | B2 | 10/2013 | Kim et al. | |
| 8,607,585 | B2 | 12/2013 | Jang et al. | |
| 2009/0126392 | A1 * | 5/2009 | An | F25D 23/126 220/361 |

(Continued)

FOREIGN PATENT DOCUMENTS

| | | | |
|---|---|---|---|
| JP | 2014139488 | A * | 7/2014 |
| KR | 2002-0031247 | A | 5/2002 |

(Continued)

OTHER PUBLICATIONS

International Search Report issued in International Application No. PCT/KR2021/005125 dated Aug. 10, 2021.

(Continued)

*Primary Examiner* — Tavia Sullens
(74) *Attorney, Agent, or Firm* — STAAS & HALSEY LLP

(57) ABSTRACT

A refrigerator which comprises: a storage compartment, a door to open and close the storage compartment, a storage tank in the storage compartment, the storage tank being provided to store water supplied from an external water supply source, and a dispenser, having a case connectable to the storage tank, to discharge water stored in the storage tank while the case is connected to the storage tank, the dispenser being attachable to and detachable from a rear surface of the door facing the storage compartment.

10 Claims, 19 Drawing Sheets

(56) References Cited

U.S. PATENT DOCUMENTS

| | | | | |
|---|---|---|---|---|
| 2010/0319389 | A1* | 12/2010 | Yang | F25D 23/126 74/519 |
| 2011/0283734 | A1 | 11/2011 | Koo | |
| 2012/0024003 | A1 | 2/2012 | Kim | |
| 2012/0227434 | A1 | 9/2012 | Kim et al. | |
| 2013/0133352 | A1 | 5/2013 | Park et al. | |
| 2015/0284237 | A1 | 10/2015 | McMahan et al. | |
| 2016/0059192 | A1* | 3/2016 | Jeong | F25D 23/126 62/344 |
| 2016/0131418 | A1 | 5/2016 | Yang | |
| 2017/0197816 | A1 | 7/2017 | Thayyullathil et al. | |
| 2018/0187964 | A1* | 7/2018 | Park | F25D 23/126 |
| 2019/0186812 | A1 | 6/2019 | Shi et al. | |
| 2020/0370813 | A1* | 11/2020 | Miller | F25C 5/187 |
| 2021/0180853 | A1 | 6/2021 | Choi | |
| 2021/0396459 | A1* | 12/2021 | Kwon | F25D 23/04 |
| 2022/0065517 | A1 | 3/2022 | You et al. | |

FOREIGN PATENT DOCUMENTS

| | | | |
|---|---|---|---|
| KR | 10-2006-0068745 | A | 6/2006 |
| KR | 10-0797481 | B1 | 1/2008 |
| KR | 10-2008-0066457 | A | 7/2008 |
| KR | 10-2011-0112377 | A | 10/2011 |
| KR | 10-2011-0117115 | A | 10/2011 |
| KR | 10-2013-0059988 | A | 6/2013 |
| KR | 10-2014-0116092 | | 10/2014 |
| KR | 10-1734620 | B1 | 5/2017 |
| KR | 10-1776297 | B1 | 9/2017 |
| KR | 10-2020-0014707 | A | 2/2020 |
| KR | 10-2021-0076354 | A | 6/2021 |

OTHER PUBLICATIONS

International Written Opinion issued in International Application No. PCT/KR2021/005125 dated Aug. 10, 2021.

* cited by examiner

REFRIGERATOR

CROSS-REFERENCE TO RELATED APPLICATIONS

This application is a continuation application, under 35 U.S.C. § 111(a), of International Patent Application No. PCT/KR2021/005125, filed on Apr. 22, 2021, which claims the benefit of Korean Patent Application No. 10-2020-0075028, filed on Jun. 19, 2020, in the Korean Intellectual Property Office, the entire disclosures of each of which are incorporated herein by reference as a part of this application.

BACKGROUND

Field

The present disclosure relates to a refrigerator, and more particularly, to a refrigerator having an improved structure with a dispenser mounted on the rear surface of a door.

Description of Related Art

In general, a refrigerator refers to a home appliance used to keep food fresh by including a storage compartment and a cool air supply device to supply cool air to the storage compartment. Such a refrigerator may include a dispenser configured to provide a user with water.

Conventional dispensers, formed at the exterior of refrigerators, are provided to supply ice or water to a user without opening a door.

However, in this case, the exterior appearance of refrigerators may not be maintained neatly, and a separate door panel to mount a dispenser at the exterior should be manufactured.

SUMMARY

In accordance with an aspect of the present disclosure, a refrigerator includes: a storage compartment; a door to open and close the storage compartment; a storage tank in the storage compartment, the storage tank being provided to store water supplied from an external water supply line; and a dispenser, having a case connectable to the storage tank, to discharge the water stored in the storage tank while the case is connected to the storage tank, the dispenser being attachable to and detachable from a rear surface of the door facing the storage compartment.

The door includes a guide which protrudes from the rear surface of the door, and the case includes a fixing rib which extends outward from one side surface of the case so that the fixing rib is coupleable to the guide.

The fixing rib includes: an insertion section to be fitted in the guide; and a holder mountable on a top surface of the guide.

The one side surface of the case is a first side surface, and the case includes a support rib which protrudes outward from a second side surface of the case opposite to the first side surface.

The refrigerator further includes a door guard attachable on and detachable from the rear surface of the door, wherein the door guard is held by the support rib of the case.

The support rib is among a plurality of support ribs provided at different heights and the door guard is mountable at the different heights.

The dispenser further includes a lever coupleable to the case, and the case includes: a lever mount recessed from a front surface to seat the lever thereon; and a fastening member coupler which extends backward from the lever mount.

The fastening member coupler is covered by the lever.

The fastening member coupler is a first fastening member coupler, and the case further includes a second fastening member coupler which extends upward so that a fastening member is insertable along a direction different from the first fastening member coupler.

The case further includes a parts-accommodating structure provided at an upper portion.

The dispenser further includes a cover provided to cover the parts-accommodating structure, and the parts-accommodating structure further includes a projection which extends upward from one side surface to guide a coupling position of the cover.

The cover includes a guide protrusion provided at a front end, and the parts-accommodating structure further includes a protrusion insertion region into which the guide protrusion is insertable while the cover is coupled.

The parts-accommodating structure includes a water outlet hole formed to discharge water.

The dispenser includes: a vessel support which extends forward from a lower portion of the front surface of the case; and a dispensing space to accommodate a vessel placed on the vessel support and receive water.

In accordance with another aspect of the present disclosure, a refrigerator includes a storage compartment, a door pivotable to open and close the storage compartment and including a guide which extends from a rear surface, and a dispenser mountable on and detachable from the rear surface of the door and having a case, wherein the case comprises a fixing rib which protrudes outward from a first side surface of the case so that the fixing rib is coupleable to by the guide and a support rib which protrudes outward from a second side surface facing the first side surface.

The refrigerator further includes a door guard attachable to and detachable from on the rear surface of the door, wherein the door guard is held between the support rib of the case and the door.

The case includes a fastening member coupler which extends backward from the front surface and formed between the first side surface and the second side surface, wherein a rotational force generated while the door guard is mounted is offset by coupling a fastening member to the fastening member coupler.

DETAILED DESCRIPTION

Figure 1:
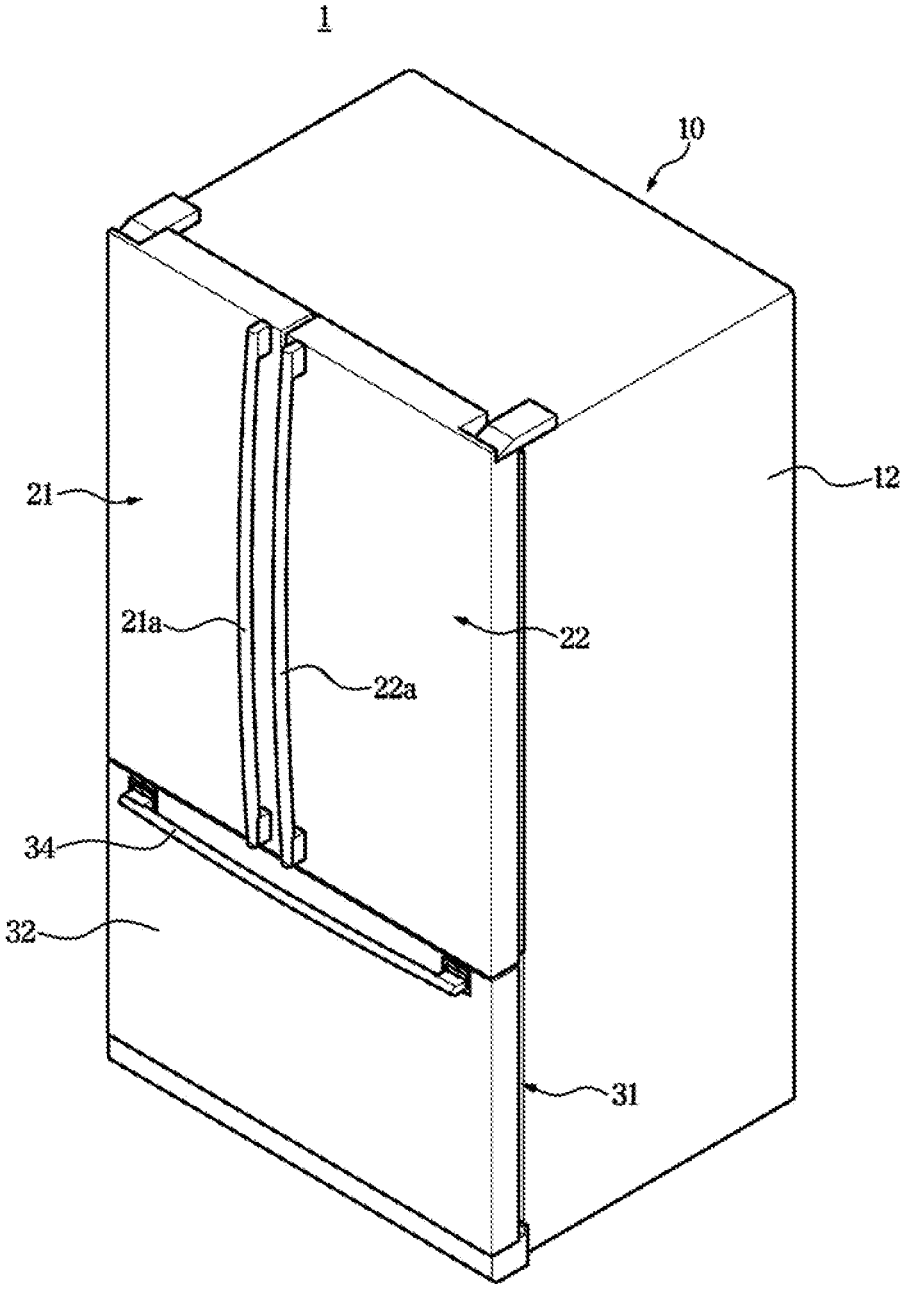
FIG. 1 is a view illustrating an exterior appearance of a refrigerator according to an embodiment of the present disclosure.

Embodiments described in the specification and shown in the drawings are only illustrative and are not intended to represent all aspects of the invention, such that various modifications may be made without departing from the spirit of the invention.

Also, throughout the specification, like reference numerals of the drawings denote like elements or components having substantially same functions.

In addition, the terms used in the present specification are merely used to describe particular embodiments, and are not intended to limit the present disclosure. An expression used in the singular encompasses the expression of the plural unless it has a clearly different meaning in the context. In the present specification, it is to be understood that the terms such as "including" or "having" etc., are intended to indicate the existence of the features, numbers, operations, components, parts, or combinations thereof disclosed in the specification, and are not intended to preclude the possibility that one or more other features, numbers, operations, components, parts, or combinations thereof may exist or may be added.

It will be understood that, although the terms "first", "second", etc., may be used herein to describe various elements, these elements should not be limited by these terms. The above terms are used only to distinguish one component from another. For example, a first component discussed below could be termed a second component, and similarly, the second component may be termed the first component without departing from the teachings of this disclosure.

Meanwhile, the terms "vertical direction", "downward", and "forward-backward direction" used throughout the specification are defined based on the drawings and the shape and position of each element are not limited by these terms.

Provided is a refrigerator including a dispenser formed on the rear surface of a door.

Provided is a refrigerator having an improved structure to increase efficiency of assembling a dispenser and a door.

Provided is a refrigerator simplifying inspection of defects in an internal water supply line of the refrigerator connected to a dispenser.

According to an embodiment of the present disclosure, aesthetic impression of the exterior appearance of the refrigerator may be improved by forming the dispenser on the rear surface of the door.

According to the present disclosure, efficiency of the interior space of the storage compartment may be increased by mounting the door guard on a side surface of the dispenser.

According to the present disclosure, a dispenser and a door may be easily assembled because the case of the dispenser includes a temporarily fixing structure.

According to the present disclosure, process inspection of the internal water supply line of the refrigerator may be performed using a simpler method.

Hereinafter, embodiments of the present disclosure will be described in detail with reference to the accompanying drawings.

Figure 2:
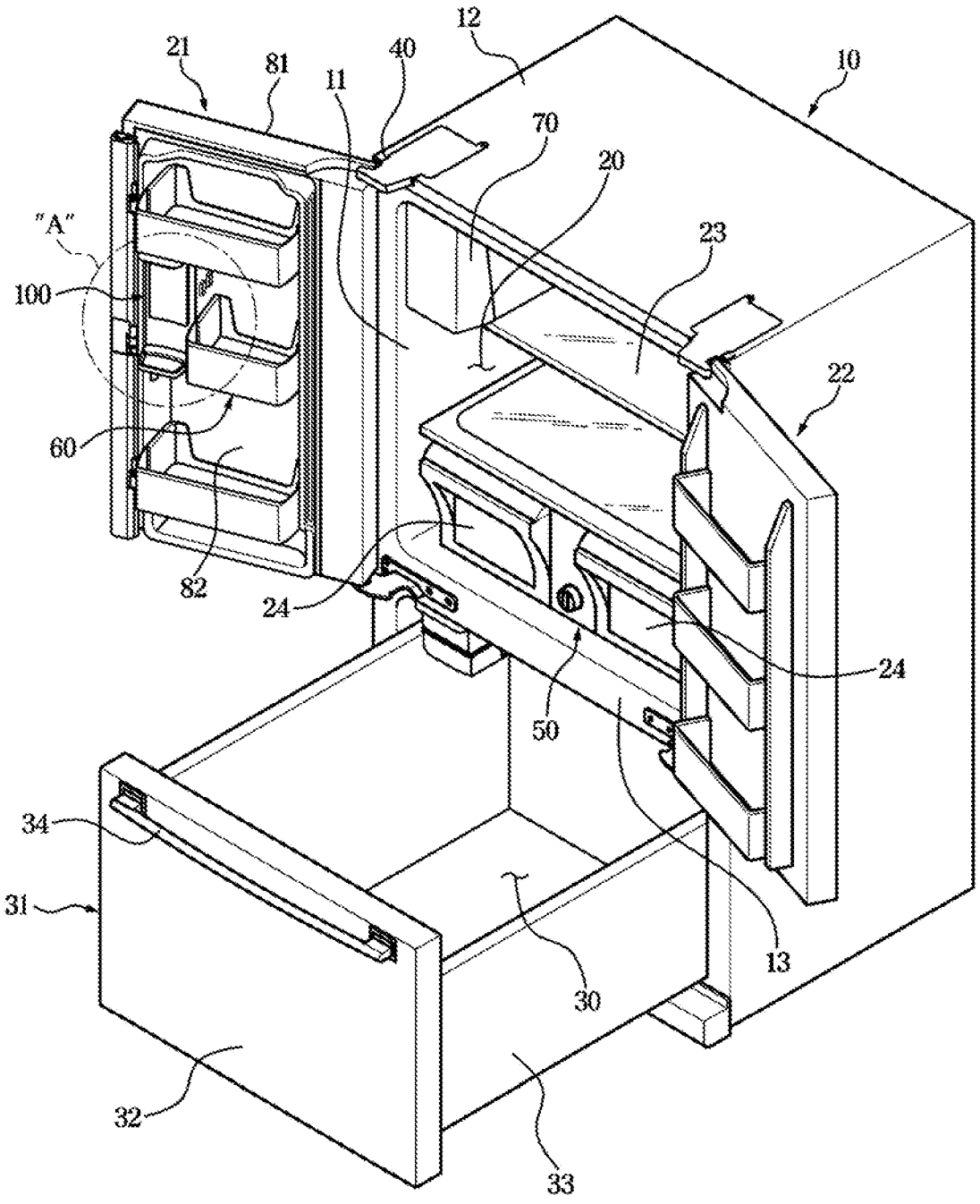
FIG. 2 is a view illustrating a state in which doors of the refrigerator of FIG. 1 is open according to an embodiment of the present disclosure.
Figure 3:
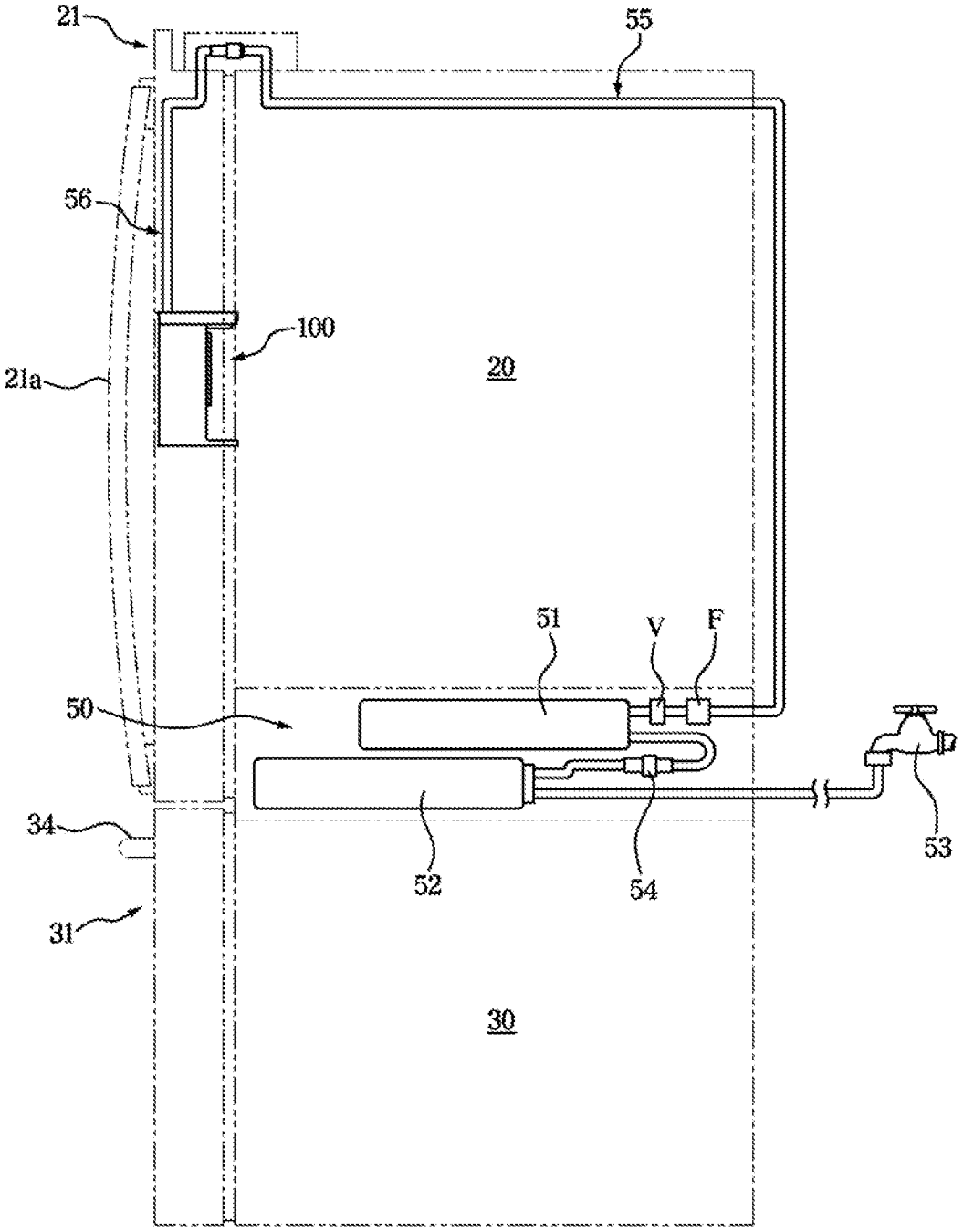
FIG. 3 is a schematic side cross-sectional view of the refrigerator shown in FIG. 1 according to an embodiment of the present disclosure.

FIG. 1 is a view illustrating an exterior appearance of a refrigerator according to an embodiment of the present disclosure. FIG. 2 is a view illustrating a state in which doors of the refrigerator of FIG. 1 are open. FIG. 3 is a schematic side cross-sectional view of the refrigerator shown in FIG. 1.

Referring to FIGS. 1 to 3, a refrigerator 1 according to an embodiment of the present disclosure may include a main body 10, storage compartments 20 and 30 formed inside the main body 10, and a door 21 provided to open and close the storage compartments 20 and 30.

Also, the refrigerator 1 may include a cool air supply device configured to supply cool air to the storage compartments 20 and 30. The cool air supply device may include an evaporator, a compressor, a condenser, and an expansion device to rotationally perform evaporation and compression of a refrigerant.

The main body 10 may include an inner cabinet 11 defining the storage compartments 20 and 30, an outer cabinet 12 coupled to outer surfaces of the inner cabinet 11, and an insulation material (not shown) interposed between the inner cabinet 11 and the outer cabinet 12.

The inner cabinet 11 may be formed of a plastic material by injection molding, and the outer cabinet 12 may be formed of a metallic material. The insulation material may be a urethane foam insulation and may be used with a vacuum insulation panel, if required.

The urethane foam insulation may be made by filling a mixture of urethane and a blowing agent between the inner cabinet 11 and the outer cabinet 12 after they are coupled with each other and allowing the resulting foam to rise. The urethane foam having a strong adhesive force may increase a binding force between the inner cabinet 11 and the outer cabinet 12 and may have sufficient strength after foaming is completed.

The main body 10 may include a middle wall 13 horizontally partitioning the storage compartment into the storage compartments 20 and 30. The middle wall 13 may separate a refrigerator compartment 20 from a freezer compartment 30.

Meanwhile, the partitioned shape of the storage compartments 20 and 30 is not limited to the example shown in FIG. 2 and the partitioning may be implemented in various shapes known in the art.

The storage compartments 20 and 30 may include a refrigerator compartment 20 formed in an upper portion of the main body 10 and a freezer compartment 30 in a lower portion of the main body 10. The freezer compartment 30 may be provided under the refrigerator compartment 20.

The refrigerator compartment 20 may be maintained at approximately 0 to 5 degrees Celsius to keep food in a chilled state. The freezer compartment 30 may be maintained at approximately −30 to 0 degrees Celsius to keep food in a frozen state.

Shelves 23 on which food is placed and storage containers 24 to store food may be provided in the refrigerator compartment 20.

Each of the refrigerator compartment 20 and the freezer compartment 30 may have an open front to put/take food into/out of the refrigerator compartment 20 and the freezer compartment 30. The open front of the refrigerator compartment 20 may be open and closed by a pair of refrigerator compartment doors 21 and 22 pivotally coupled to the main body 10 by hinges 40. The refrigerator compartment doors 21 and 22 may be pivotally coupled to the main body 10. The open front of the freezer compartment 30 may be open and closed by a freezer compartment door 31 sliding with respect to the main body 10.

A gasket (not shown) may be mounted along boundaries of rear surfaces of the refrigerator compartment doors 21 and 22 to prevent leakage of cool air from the refrigerator compartment 20 when the refrigerator compartment doors 21 and 22 are closed by sealing gaps between the refrigerator compartment doors 21 and 22 and the main body 10.

The refrigerator compartment doors 21 and 22 may include handles 21*a* and 22*a* grabbed by a user for easy opening and closing of the refrigerator compartment doors 21 and 22. The handles 21*a* and 22*a* may have a vertically elongated shape.

The refrigerator compartment doors 21 and 22 may include a door outer cabinet 81 and a door inner cabinet 82. The door inner cabinet 82 may constitute the rear surface of the door 21. The door outer cabinet 81 may define an exterior appearance of the door 21 and the door inner cabinet 82 may be coupled to the door outer cabinet 81. An insulation material may be provided between the door inner cabinet 82 and the door outer cabinet 81. Accordingly, leakage of cool air from the refrigerator 1 via the door 21 may be prevented. As well as the refrigerator compartment doors 21 and 22, a freezer compartment door 31 may have the same configuration.

Between the refrigerator compartment doors 21 and 22, a dispenser 100 may be provided at the first refrigerator compartment door 21. More particularly, the dispenser 100 may be provided at the rear surface of the first refrigerator compartment door 21, and in other words, the dispenser 100 may be mounted on the door inner cabinet 82 of a first refrigerator compartment door 21. Although the dispenser 100 mounted on the first refrigerator compartment door 21 is illustrated in FIG. 2, the position of the dispenser 100 is not limited thereto, and the dispenser 100 may also be provided at a second refrigerator compartment door 22. The dispenser 100 will be described below in more detail.

The refrigerator 1 may further include an ice maker 70 provided at a portion of the storage compartment 20. However, the ice maker 70 is not necessarily provided.

The freezer compartment door 31 may include a door 32 covering the open front of the freezer compartment 30 and a basket 33 coupled to the rear surface of the door 32. The basket 33 may be slidably supported by rails. A handle 34 may be provided at the door 32.

A storage tank assembly 50 may be provided to store water in the refrigerator compartment 20. The storage tank assembly 50 may include a storage tank 51 and a water filter 52.

The storage tank assembly 50 may be disposed between a plurality of storage containers 24 as shown in FIG. 2. However, the position of the storage tank assembly 50 is not limited thereto as long as the storage assembly 50 is disposed inside the refrigerator compartment 20 and water contained in the storage tank 51 of the storage tank assembly 50 is cooled by the cool air inside the refrigerator compartment 20.

The storage tank 51 may be connected to an external water supply line 53 such as a tap line and may store water purified by the water filter 52. A control valve (not shown) to adjust water supplied from the external water supply line 53 may be provided at a hose connecting the external water supply line 53 with the storage tank 51.

The water filter 52 may be disposed in a flow path between the external water supply line 53 and the dispenser 100 which will be described below to purify water supplied from the external water supply line 53.

The storage tank assembly 50 may include a valve 54 connecting the water filter 52 with the storage tank 51. The valve 54 may selectively supply water purified by the water filter 52 to the storage tank 51. However, the position of the valve 54 is not limited thereto.

Meanwhile, a water valve V may be provided at a water supply hose connecting the storage tank 51 with the dispenser 100. Accordingly, the refrigerator 1 according to an embodiment of the present disclosure may adjust an amount of water supplied through the dispenser 100 via the flow path by controlling a degree of opening the water valve V. In addition, a flow sensor F may be provided at the water supply hose to measure the amount of water supplied to the dispenser 100.

The refrigerator 1 may include a plurality of water supply flow paths 55 and 56 connecting the external water supply line 53 with the dispenser 100 to supply water to the dispenser 100. The plurality of water supply flow paths may include a first water supply flow path 55 and a second water supply flow path 56. The first water supply flow path 55 may be provided inside the main body 10, and the second water supply flow path 56 may be provided inside the refrigerator compartment door 21. More specifically, the second water supply flow path 56 may be provided inside the first refrigerator compartment door 21 on which the dispenser 100 is mounted.

The first water supply flow path 55 may be connected to the second water supply flow path 56 via a hinge 40 of the door 21 to constitute the entire water supply flow path through which water flows to the dispenser 100.

Water of the external water supply line 53 may be supplied to the dispenser 100 by a water pressure of the external water supply line 53 and by controlling the control valve 54. The first water supply flow path 55 may be provided to pass through the water filter 52 such that water flowing from the external water supply line 53 is purified while passing through the water filter 52 and then supplied to the dispenser 100.

In addition, the first water supply flow path 55 may be provided to pass through the storage tank 51. Therefore, water flowing from the external water supply line 53 may be cooled in the storage tank 51 and then supplied to the dispenser 100.

Figure 4:
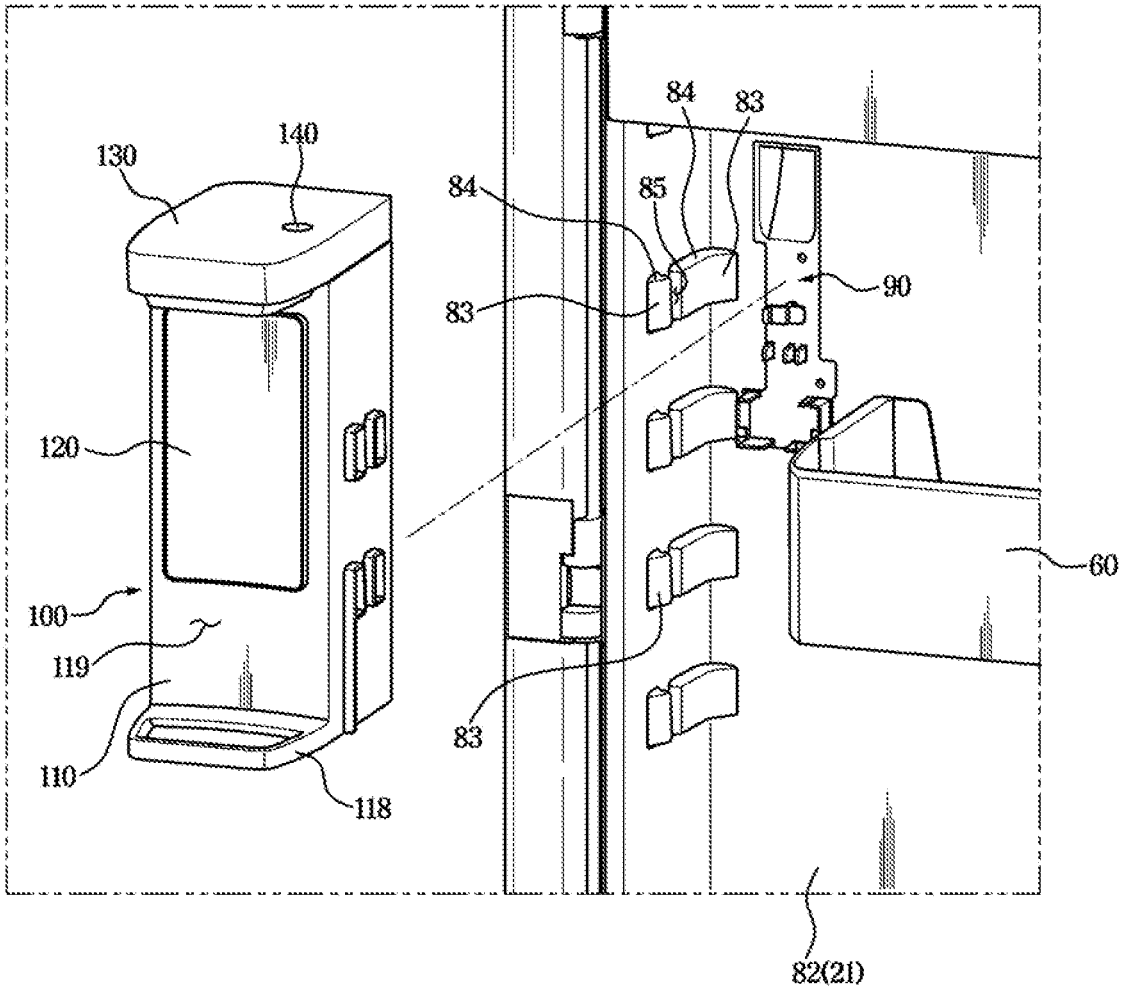
FIG. 4 is a view of area A of FIG. 2 illustrating a state where a dispenser is separated from a door according to an embodiment of the present disclosure.
Figure 5:
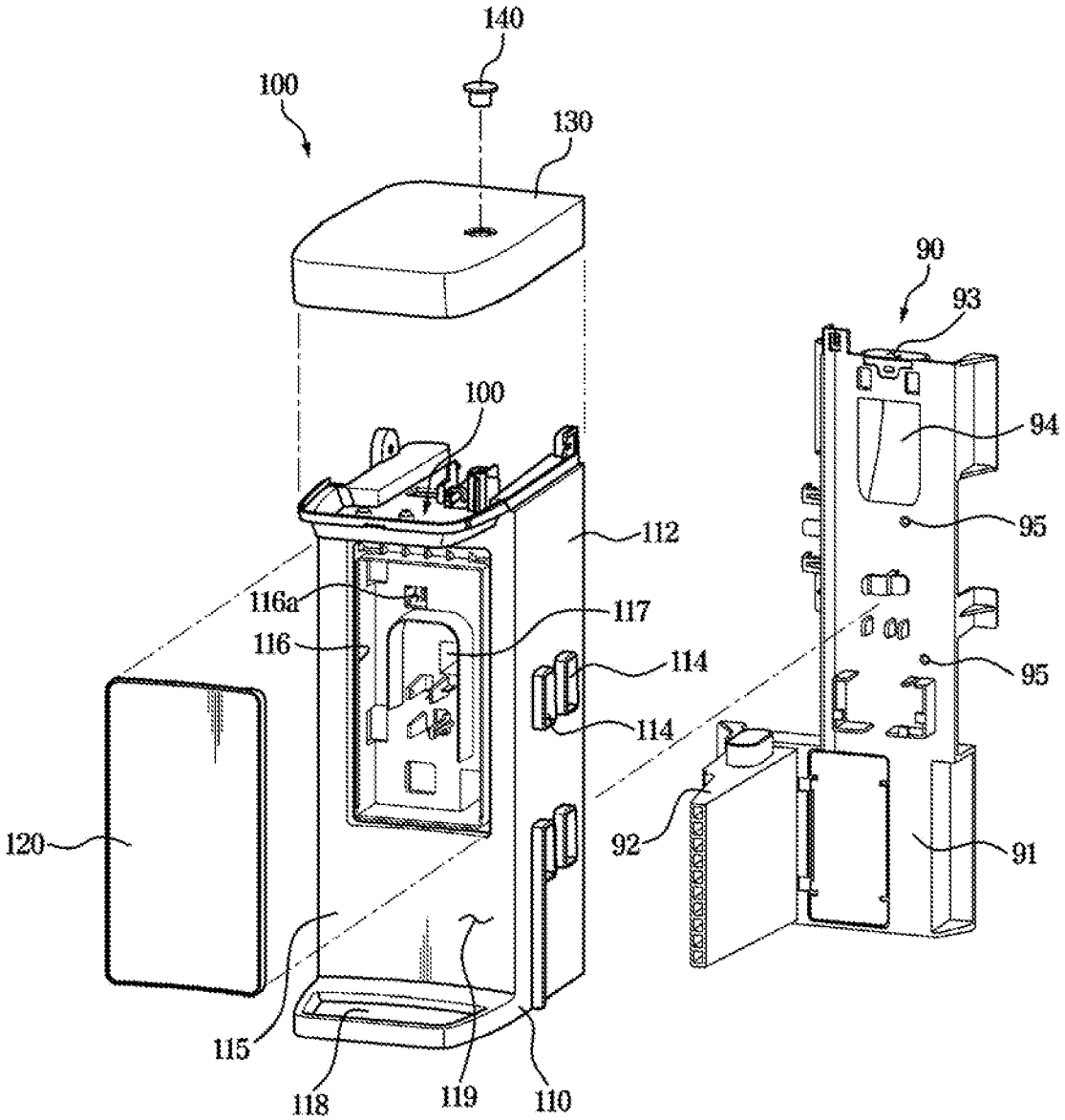
FIG. 5 is an exploded view of a door bracket and a dispenser shown in FIG. 2 according to an embodiment of the present disclosure.
Figure 6:
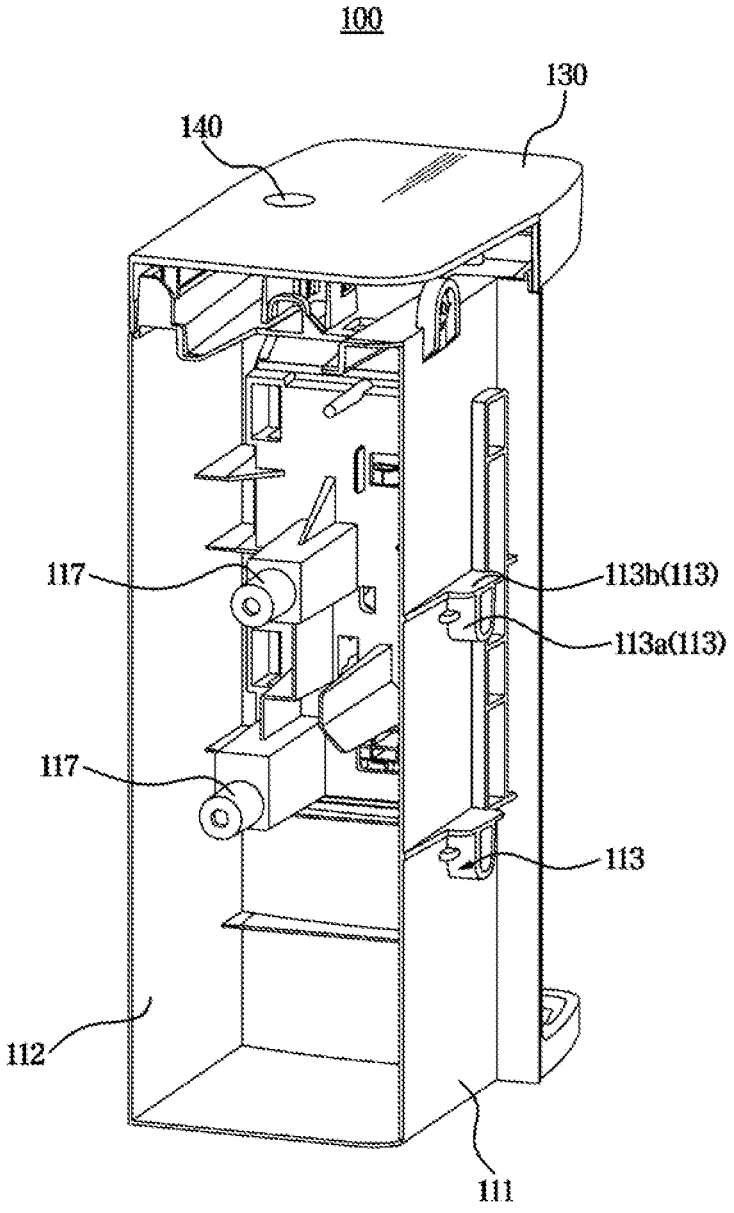
FIG. 6 is a rear view of a dispenser of a refrigerator according to an embodiment of the present disclosure according to an embodiment of the present disclosure.
Figure 7:
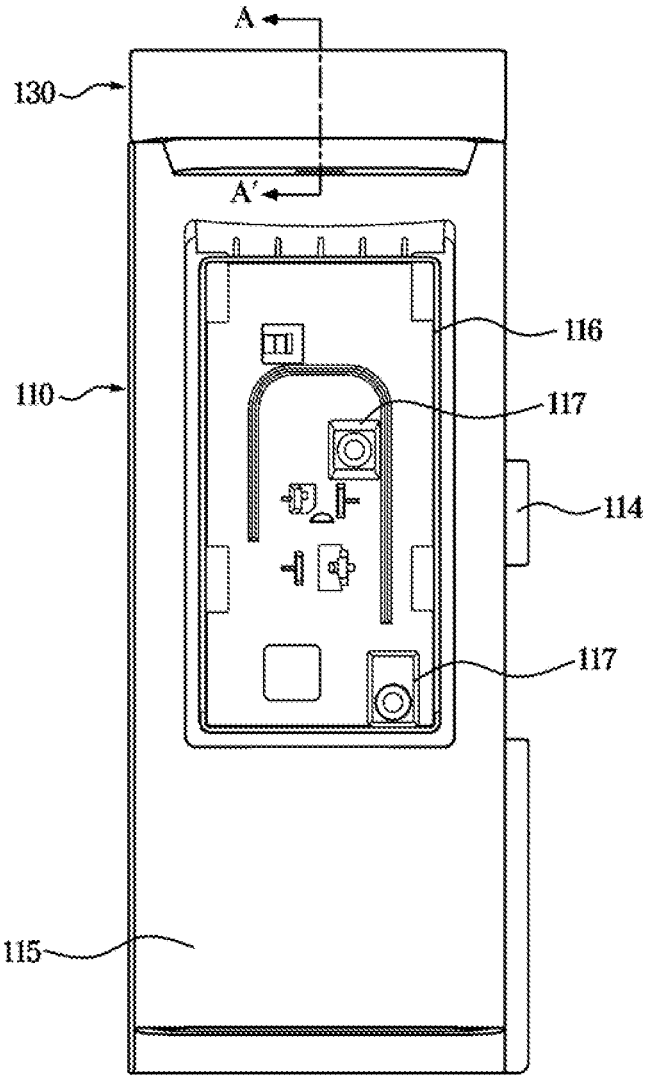
FIG. 7 is a front view of a dispenser illustrated in FIG. 6 from which a lever is removed according to an embodiment of the present disclosure.

FIG. 4 is an enlarged view of area A of FIG. 2 illustrating a state where a dispenser is separated from a door. FIG. 5 is an exploded view of a door bracket and a dispenser shown in FIG. 2. FIG. 6 is a rear view of a dispenser of a refrigerator according to an embodiment of the present disclosure. FIG. 7 is a front view of a dispenser illustrated in FIG. 6 from which a lever is removed.

Referring to FIG. 4, the dispenser 100 may be detachably provided on the rear surface of the first refrigerator compartment door 21. In other words, the dispenser 100 may be mounted on the door inner cabinet 82 of the first refrigerator compartment door 21 of the refrigerator 1. Hereinafter, the first refrigerator compartment door 21 will be referred to as door 21.

The rear surface of the door 21 refers to a surface facing the refrigerator compartment 20 when the refrigerator compartment 20 is closed by the door 21. In other words, the rear surface of the door 21 may be a surface forming one surface of the storage compartment 20. In the following descriptions, forward and backward are defined with respect to the dispenser 100, i.e., a direction where a lever 120 is mounted is defined as forward and the opposite direction is defined as backward.

The door 21 may include a guide 83 protruding inward from the rear surface. Specifically, the guide 83 may protrude inward from the door inner cabinet 82. The guide 83 may be formed on approximately a side of the door inner cabinet 82.

The guide 83 may be provided in plural. Although four guides 83 are shown in FIG. 4 of the present disclosure, the number of the guides 83 is not limited thereto.

The guide 83 formed at the same height of the door inner cabinet 82 may be provided as a pair. Thus, a guide groove 85 may be formed between the pair of guides 83 protruding inward. Therefore, a fixing rib 113 of the case 110 which will be described below is inserted into the guide groove 85 to fix the position of the case 110.

The door 21 may include a mounting surface 84 formed at the top of the guide 83. The mounting surface 84 may be the top surface of the guide 83. As a holder 113*b* of the fixing rib 113 which will be described below is mounted on the mounting surface 84, vertical movement of the case 110 may be prevented.

Referring to FIGS. 4 to 7, the dispenser 100 may be detachably mounted on the rear surface of the door 21.

The dispenser 100 may include a case 110 and a lever 120. Also, the dispenser 100 may include a cover 130 mounted on the top of the case 110. The dispenser 100 may include a cap 140 mounted at the cover 130. The dispenser 100 may be coupled to a door bracket 90.

The case 110 may include a front surface 115 provided at the front and a first side surface 111 connected to the front surface 115 in contact with the door inner cabinet 82. Also, the case 110 may include a second side surface 112 opposite to the first side surface 111. The second side surface 112 may also be connected to the front surface 115.

The fixing rib 113 may be formed at the first side surface 111 of the case 110, and a support rib 114 may be formed at the second side surface 112.

First, the support rib 114 of the second side surface 112 will be described.

The case 110 may include the support rib 114 protruding outward from the second side surface 112. Specifically, the support rib 114 formed at the same height may be provided as a pair. In addition, the support rib 114 may be formed in plural at different heights. A door guard 60 which will be described below may be mounted on the support rib 114. Thus, the door guard 60 may be mounted at different heights in accordance with the position of the support rib 114. Detailed descriptions thereof will be given below.

Referring to FIG. 6, the fixing rib 113 provided at the first side surface 111 will be described.

As shown in FIG. 6, the case 110 may include a fixing rib 113 extending outward from the first side surface 111. More particularly, the fixing rib 113 may extend toward the guide 83 of the door 21 from the first side surface 111. The fixing rib 113 may be restrained by the guide 83 and fixed.

The fixing rib 113 may include an insertion section 113*a* fitted into the guide 83 and a holder 113*b* mounted on a top surface 131 of the guide 83.

The insertion section 113*a* is formed in an approximately U-shape and extends outward from the case 110. The holder 113*b* horizontally extends outward from the case 110 to be formed on the top of the insertion section 113*a*. When the case 110 is mounted on the rear surface of the door 21, the fixing rib 113 is inserted into the guide 83 and fitted therein such that the position of the case 110 is fixed without shaking.

That is, the insertion section 113*a* of the fixing rib 113 is inserted into the guide groove 85 and restrained by the protruding guide 83 so that the forward-backward movement of the case 110 is limited. In addition, the holder 113*b* of the fixing rib 113 is supported by the mounting surface 84 of the guide 83 so that the downward movement of the case 110 may be limited.

Thereby, the case 110 may be temporarily fixed to the rear surface of the door 21 although a separate fastening member is not coupled thereto. In other words, because the position of the case 110 is fixed even before the fastening member is coupled thereto, convenience of workers or users may be enhanced.

The lever 120 may be coupled to the front surface 115 of the case 110. The lever 120 may be exposed to a user. The lever 120 may be connected to a controller (not shown) so that water supply may proceed in the case where a user places a vessel such as a cup in a dispensing space 119 and presses the lever 120.

The case 110 may include a vessel support 118 extending forward from a lower portion of the front surface 115. The dispensing space 119 may be provided above the vessel support 118 to accommodate a vessel. Thereby, the vessel may receive water discharged from the upper portion of the dispensing space 119.

The case 110 may include a lever mount 116 recessed backward from the front surface 115 such that the lever 120 is mounted thereon. The lever mount 116 may include an electric wire passing hole 116*a* through which the electric wire connected to the lever 120 passes.

Also, the case 110 may include a fastening member coupler 117 extending backward from the lever mount 116 such that a fastening member is inserted thereinto. This may be referred to as a first fastening member coupler 117.

The first fastening member coupler 117 may be formed between the first side surface 111 and the second side surface 112. The first fastening member coupler 117 covered with the lever 120, which is installed in front thereof, may not be exposed to the user. Thereby, the exterior appearance of the dispenser 100 may be maintained neatly.

The case 110 may be coupled to the door 21 by a fastening member via the first fastening member coupler 117. More specifically, the fastening member may be coupled to the door bracket 90, which is mounted on the rear surface of the door 21, after passing through the first fastening member coupler 117 of the case 110. The fastening member may be mounted on a coupling groove 95, which will be described below, formed at the door bracket 90.

The cover 130 may be mounted on the top of the case 110. Specifically, the cover 130 may be mounted to cover a parts-accommodating structure 200 of the case 110 which will be described below.

Also, a cap 140 covering coupling of the fastening member may be mounted at a top surface 131 of the cover 130. Coupling of the cover 130 to the case 110 will be described below.

As shown in FIGS. 4 and 5, the door 21 may include a door bracket 90.

The door bracket 90 may be mounted on the door inner cabinet 82 such that the dispenser 100 is coupled thereto. The door bracket 90 may be coupled to the door inner cabinet 82 before the insulation material is filled in the gap between the door outer cabinet 81 and the door inner cabinet 82.

The door bracket 90 may be provided such that a hose constituting the second water supply flow path 56 provided in the door 21 passes therethrough. That is, the second water supply flow path 56 may be connected to the dispenser 100 via the door bracket 90. The door bracket 90 may be formed by injection molding.

The door bracket 90 may include an inner cabinet coupler 91 coupled to the door inner cabinet 82. In addition, the door bracket 90 may include a door support 92 that supports at least one portion of the door inner cabinet 82 and/or the door outer cabinet 81.

The door bracket 90 may have an opening 93 through which the second water supply flow path 56 passes. The hose constituting the second water supply flow path 56 may pass through the opening 93 to be connected to a fitting member 150 (FIG. 8) which will be described below. Thereby, the second water supply flow path 56 may extend to a dispensing space 119 of the dispenser 100.

The door bracket 90 may include a guide 94 obliquely extending from the front of the door bracket 90 to form the opening 93.

The door bracket 90 may include a coupling groove 95. Specifically, the coupling groove 95 may be formed at a position corresponding to the first fastening member coupler 117 of the dispenser 100 and a fastening member may be fastened thereto.

Figure 8:
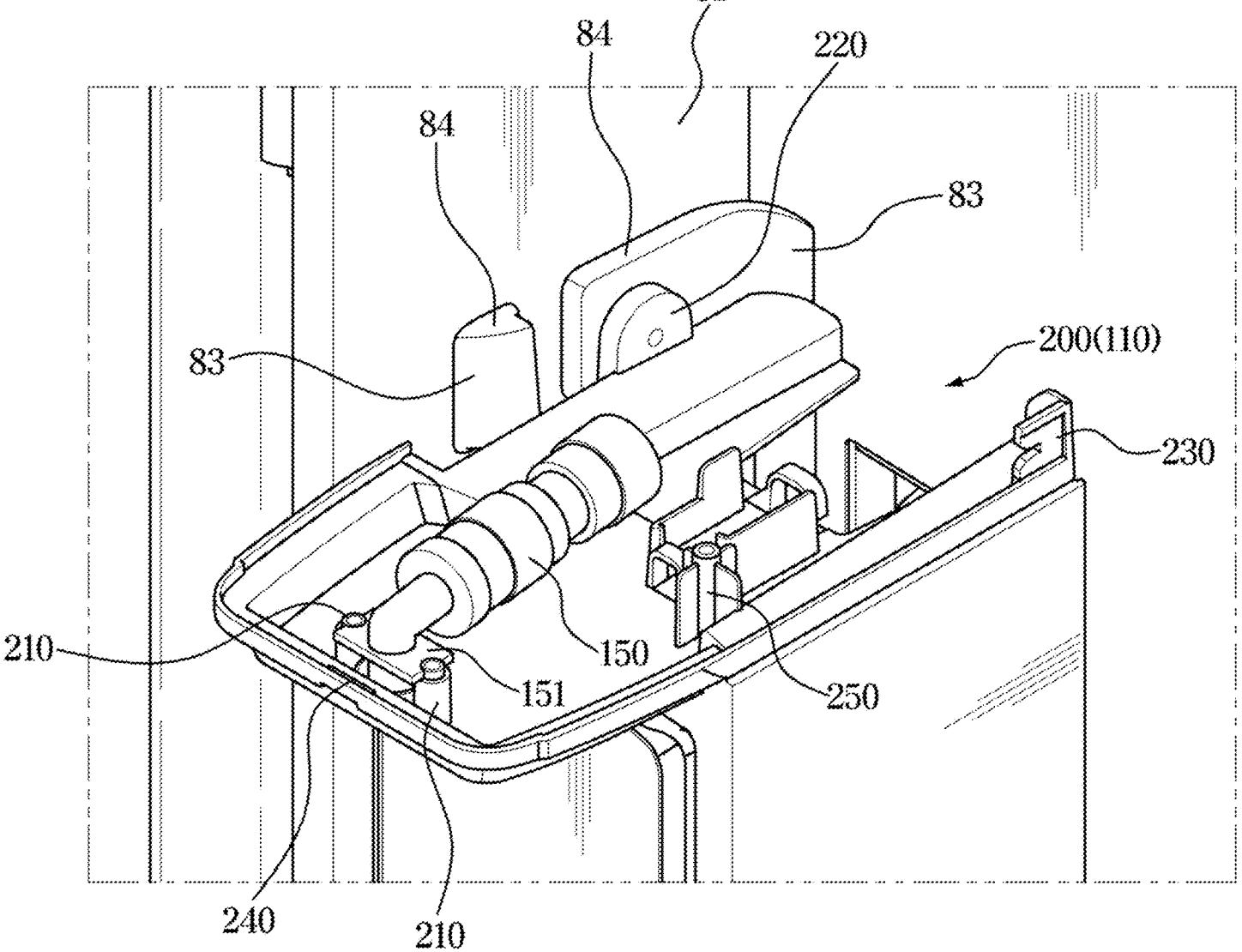
FIG. 8 is an enlarged view of an upper region of a case in a dispenser of a refrigerator according to an embodiment of the present disclosure.
Figure 9:
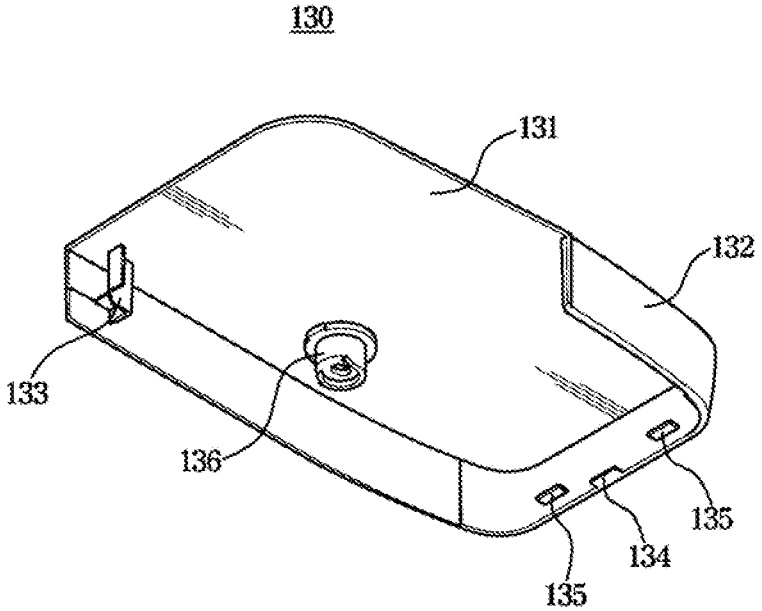
FIG. 9 is a rear-bottom perspective view of a cover in a dispenser of a refrigerator according to an embodiment of the present disclosure.
Figure 10:
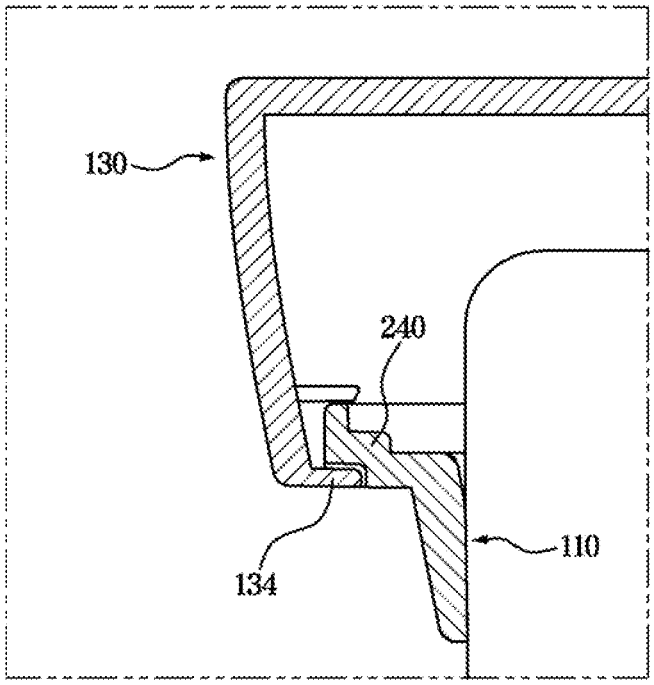
FIG. 10 is a partial cross-sectional view taken along line A-A' of FIG. 7 according to an embodiment of the present disclosure.

FIG. 8 is an enlarged view of the top of a case in a dispenser of a refrigerator according to an embodiment of the present disclosure. FIG. 9 is a rear-bottom perspective view of a cover in a dispenser of a refrigerator according to an embodiment of the present disclosure. FIG. 10 is a partial cross-sectional view taken along line A-A' of FIG. 7.

Referring to FIGS. 8 to 10, the case 110 may include a parts-accommodating structure 200.

A fitting member 150 may be coupled to the parts-accommodating structure 200. The fitting member 150 may be connected to a fixing flange 151 to be supported by a support protrusion 210 of the parts-accommodating structure 200. Thereby, the position of the fitting member 150 may be fixed.

The parts-accommodating structure 200 may include a second fastening member coupler 220 at one side. The second fastening member coupler 220 may extend upward from the first side surface 111 of the case 110. A fastening member may be coupled thereto via the second fastening member coupler 220. Thereby, the case 110 may be coupled to the door 21. The second fastening member coupler 220 may be provided to be in contact with the guide 83 of the door 21.

As described above, the first fastening member coupler 117 may be provided to extend backward from the front surface 115 of the case 110 such that a fastening member is coupled backward from the front of the dispenser 100. On the contrary, the second fastening member coupler 220 may be provided such that a fastening member is coupled in a direction approximately perpendicular to the first fastening member coupler 117. Because the case 110 includes the first fastening member coupler 117 and the second fastening member coupler 220, the case 110 may be firmly coupled to the door 21 in multiple directions.

The parts-accommodating structure 200 may include a projection 230 extending upward from a position adjacent to the second side surface 112. The projection 230 may be provided to have a shape corresponding to the fixing flange 151 of the cover 130 which will be described below. The projection 230 may be provided to guide a coupling position of the cover 130 by supporting a corner of the cover 130. That is, in the case where the cover 130 is coupled to the parts-accommodating structure 200 of the case 110 by the projection 230, the position of the cover 130 may be temporarily fixed.

The parts-accommodating structure 200 may have a protrusion insertion region 240. The protrusion insertion region 240 may be located at one end of the front of the parts-accommodating structure 200. More specifically, the protrusion insertion region 240 may be located at the center of the front end to be adjacent to the support protrusion 210 provided to support the fitting member 150.

As illustrated in FIG. 10 in detail, the protrusion insertion region 240 may be formed to be bent from the outside of the case 110 toward the inside of the parts-accommodating structure 200. A guide protrusion 134 of the cover 130 which will be described below may be inserted into the protrusion insertion region 240.

In addition, the parts-accommodating structure 200 may include a cover coupler 250. The cover coupler 250 may extend upward from the parts-accommodating structure 200 such that the cover 130 is coupled to the case 110. A separate fastening member may be coupled to the cover coupler 250 such that the cover 130 is coupled to the parts-accommodating structure 200.

The cover 130 may include the top surface 131 approximately horizontally formed to cover the dispenser 100 and an edge 132 extending downward from one portion of the top surface 131.

The cover 130 may include a flange 133 extending inward from the edge 132. The flange 133 may be provided to be supported by the projection 230 formed at the parts-accommodating structure 200. The flange 133 may be provided at a rear portion of the cover 130 at a position corresponding to the projection 230.

The cover 130 may include a guide protrusion 134 and a pair of holding protrusions 135 formed at a front central region. The guide protrusion 134 and the pair of holding protrusions 135 may be provided to extend backward from the edge 132 of the cover 130. The guide protrusion 134 and the holding protrusions 135 may be formed at different heights. The holding protrusion 135 may be provided at a higher position than the guide protrusion 134. The holding protrusions 135 may be seated at the front end on the parts-accommodating structure 200.

The guide protrusion 134 may be inserted into the protrusion insertion region 240 of the parts-accommodating structure 200 so that the cover 130 is mounted on the case 110 at a fixed position without using a separate fastening member. In addition, the temporarily fixed state of the cover 130 may be firmly maintained by using the holding protrusions 135 together therewith.

Therefore, the coupling position of the cover 130 may be guided at both sides by the mounting surface 84 of the guide 83 formed at the door inner cabinet 82 and the projection 230 formed at the parts-accommodating structure 200 of the case 110. That is, the mounting surface 84 of the guide 83 and the projection 230 of the parts-accommodating structure 200 may support the cover 130 at the same height. Thereafter, by inserting the guide protrusion 134 of the cover 130 into the protrusion insertion region 240 of the parts-accommodating structure 200, the position of the cover 130 may be fixed to the case 110 at the front of the cover 130 without using a separate fastening member.

Also, the cover 130 may include a fastener 136. The fastener 136 may extend downward from the top surface 131 of the cover 130 to be located between the edges 132. The fastener 136 may be formed at a position corresponding to the cover coupler 250 of the parts-accommodating structure 200.

In a state where the cover 130 is temporarily fixed to the case 110, the fastening member penetrates the fastener 136 of the cover 130 and the cover coupler 250 of the parts-accommodating structure 200 so that the cover 130 may be coupled to the case 110.

A separate cap 140 may be mounted at the cover 130 to cover the fastener 136 of the cover 130 to prevent the fastening member from being exposed to the user. Thereby, the exterior appearance of the dispenser 100 may be maintained neatly.

Figure 11:
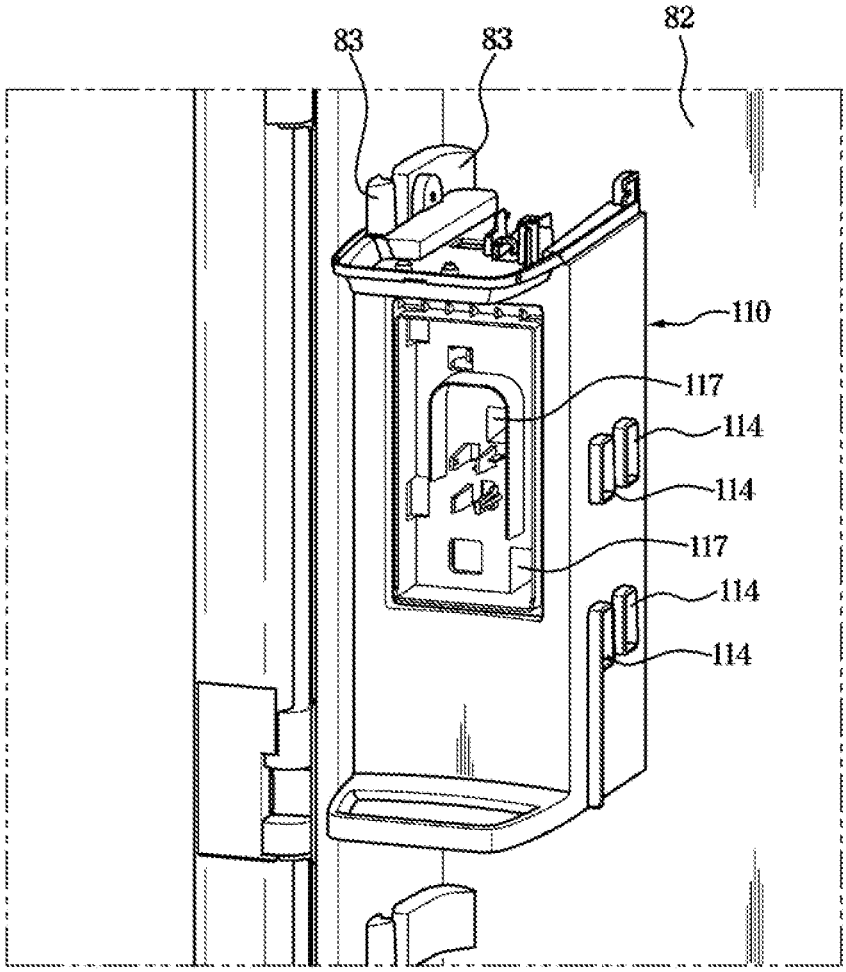
FIG. 11 is a view illustrating a state where a case is fixed to a door in a refrigerator according to an embodiment of the present disclosure.
Figure 12:
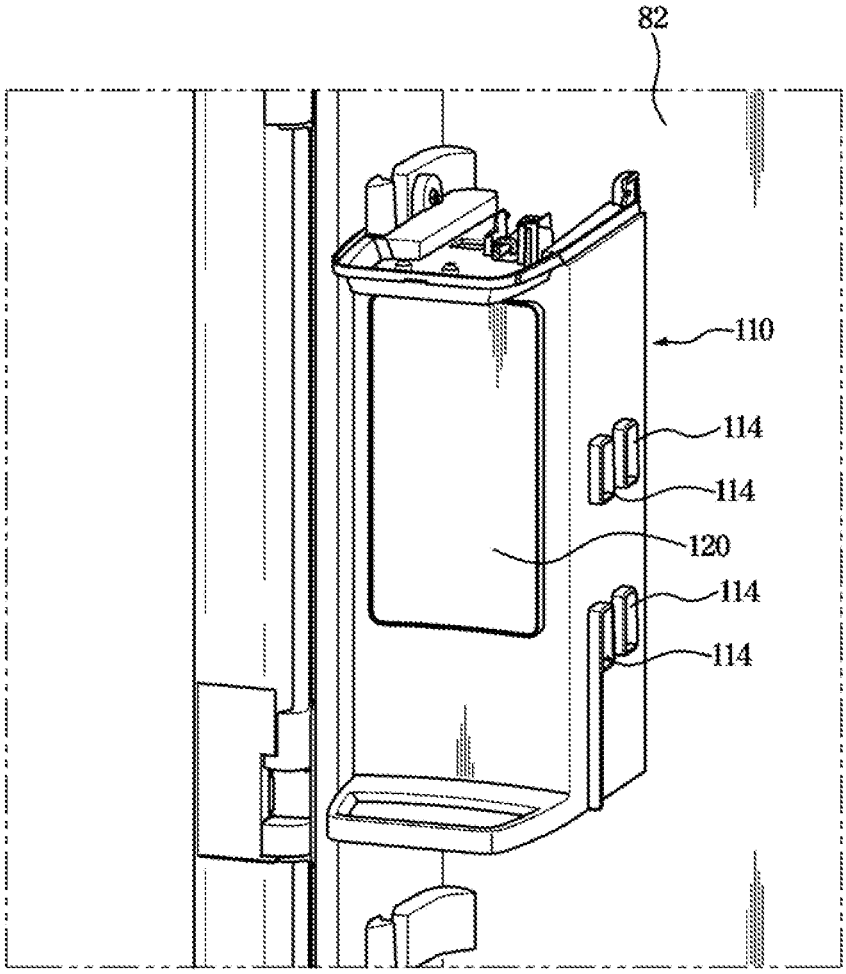
FIG. 12 is a view illustrating a state where a lever is mount on the case of FIG. 11 according to an embodiment of the present disclosure.
Figure 13:
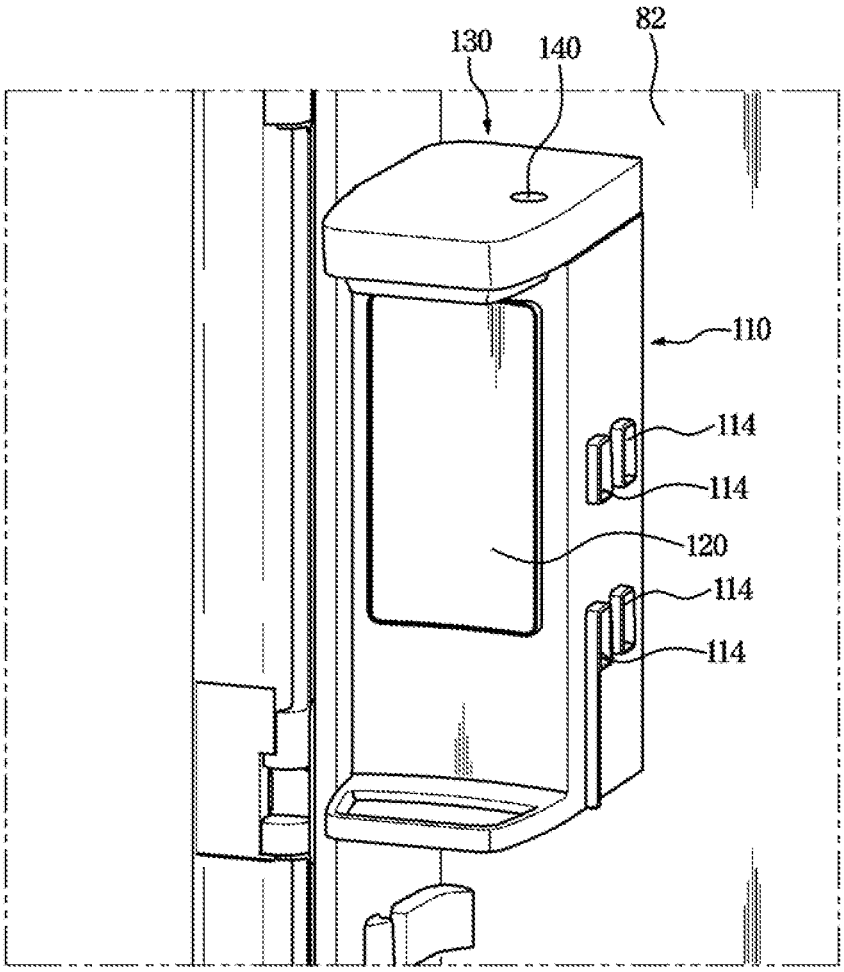
FIG. 13 is a view illustrating a state where a cover is mounted on the case of FIG. 12 according to an embodiment of the present disclosure.
Figure 14:
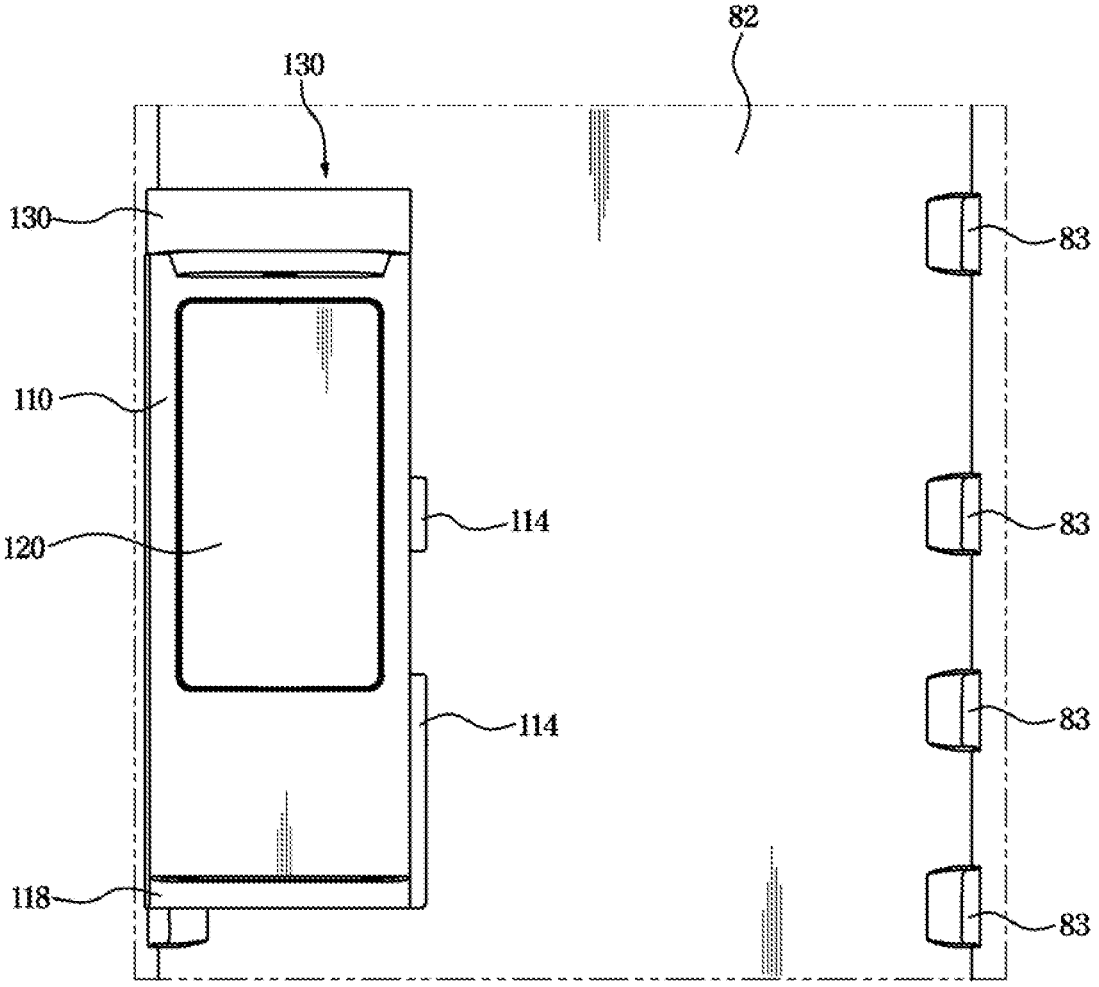
FIG. 14 is a front view illustrating the state of FIG. 13 according to an embodiment of the present disclosure.
Figure 15:
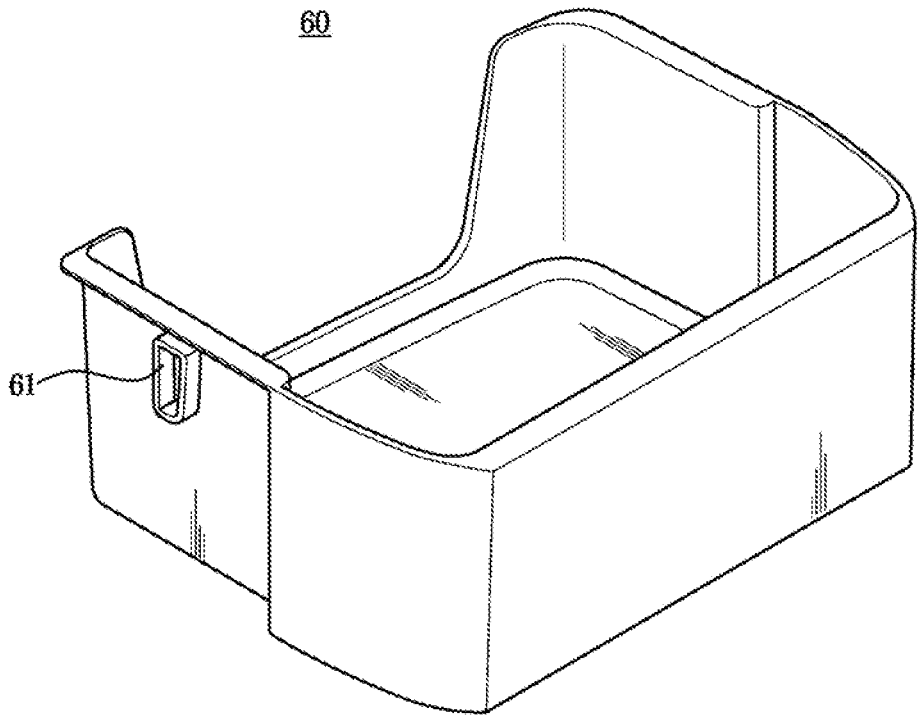
FIG. 15 is a view illustrating a door guard of a refrigerator according to an embodiment of the present disclosure.
Figure 16:
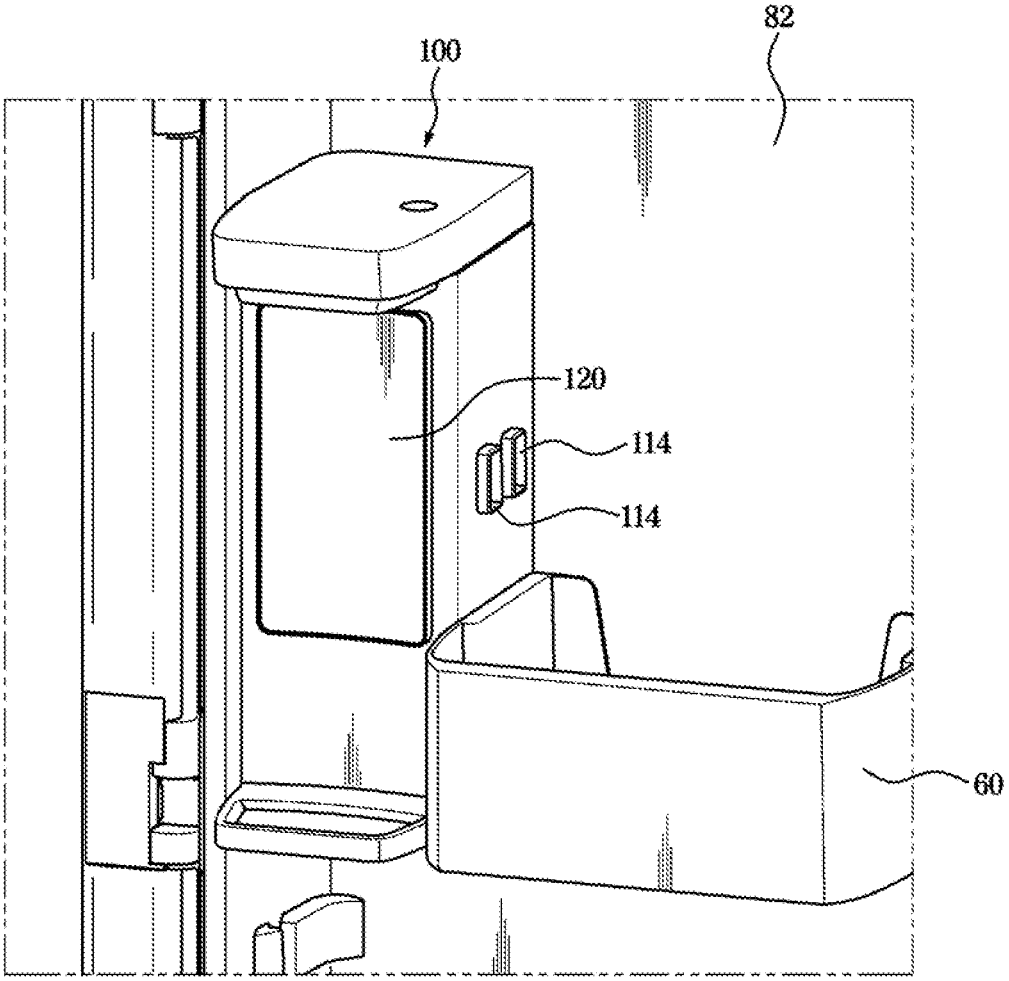
FIG. 16 is a view illustrating a state where the door guard is mounted on the case and the door of FIG. 12 according to an embodiment of the present disclosure.

FIG. 11 is a view illustrating a state where a case is fixed to a door in a refrigerator according to an embodiment of the present disclosure. FIG. 12 is a view illustrating a state where a lever is mount on the case of FIG. 11. FIG. 13 is a view illustrating a state where a cover is mounted on the case of FIG. 12. FIG. 14 is a front view illustrating the state of FIG. 13. FIG. 15 is a view illustrating a door guard of a refrigerator according to an embodiment of the present disclosure. FIG. 16 is a view illustrating a state where the door guard is mounted on the case and the door of FIG. 12.

Referring to FIGS. 11 to 16, a process of assembling the dispenser 100 onto the rear surface of the door 21 will be described. In addition, a process of mounting the door guard 60 on the dispenser 100 and the rear surface of the door 21 will be described.

As shown in FIG. 11, the case 110 of the dispenser 100 may be temporarily fixed to the door inner cabinet 82.

Because the fixing rib 113 of the case 110 is inserted into the guide 83 formed at the door inner cabinet 82, the position of the case 110 may be temporarily fixed without using a separate fastening member.

Thereafter, one fastening member may be coupled to the door bracket 90 backward from the front of the case 110 through the first fastening member coupler 117. Also, another fastening member may be coupled to the door inner cabinet 82 at a side of the case 110 through the second fastening member coupler 220.

Then, as shown in FIG. 12, after the case 110 is coupled to the door inner cabinet 82, the lever 120 may be mounted on the front of the case 110. By covering the first fastening member coupler 117 with the lever 120, parts of the fastening member may not be exposed to the user.

Then, as shown in FIG. 13, the cover 130 may be coupled to the top of the case 110. The cover 130 may be provided to cover the parts-accommodating structure 200 of the case 110. As described above, the position of the cover 130 may be temporarily fixed by the parts-accommodating structure 200 of the case 110.

Thereafter, the fastening member is coupled thereto by the fastener 136 of the cover 130, so that the cover 130 may be coupled to the case 110. The cap 140 may be coupled to the top surface 131 of the cover 130 to prevent the fastener 136 of the cover 130 from being exposed to the user.

Thereby, the dispenser 100 may be mounted on the door inner cabinet 82. In other words, the dispenser 100 may be mounted on the rear surface of the door 21.

As shown in FIG. 14, the door 21 may further include a guide 83 at the opposite side to the side mounted with the dispenser 100. A door guard 60 may be mounted on the support rib 114 formed on the second side surface 112 of the dispenser 100 and the guide 83 of the door 21. Thereby, the door guard 60 may be detachably mounted on the rear surface of the door 21.

Referring to FIGS. 13 to 16, the door guard 60 may include a guard fixing rib 61 protruding outward from a side surface. Although one side surface of the door guard 60 is shown in FIG. 15, the guard fixing rib 61 may also be formed on the opposite side surface. That is, the door guard 60 may include the guard fixing ribs 61 protruding from both side surfaces. The guard fixing rib 61 may be held by the support rib 114 formed at the case 110 of the dispenser 100.

Specifically, the support rib 114 formed on the case 110 of the dispenser 100 may be provided as a pair at the same height so that the guard fixing rib 61 is inserted between the support ribs 114. In this case, at least one of the pair of the support ribs 114 at the same height may be obliquely provided with respect to an insertion direction of the guard fixing rib 61 such that the guard fixing rib 61 is fitted between the pair of support ribs 114. Thereby, the door guard 60 may be stably mounted between the dispenser 100 and the door inner cabinet 82 at a fixed position.

Because the dispenser 100 is coupled to the rear surface of the door 21 as described above, the exterior appearance of the refrigerator may be neatly maintained to improve aesthetic impression.

Also, by using the temporarily fixing structure of the case of the dispenser, working efficiency of workers may be increased and the process may be simplified.

In addition, because the door guard is mounted between the dispenser and the door, utilization of the interior space of the refrigerator may be improved.

Figure 17:
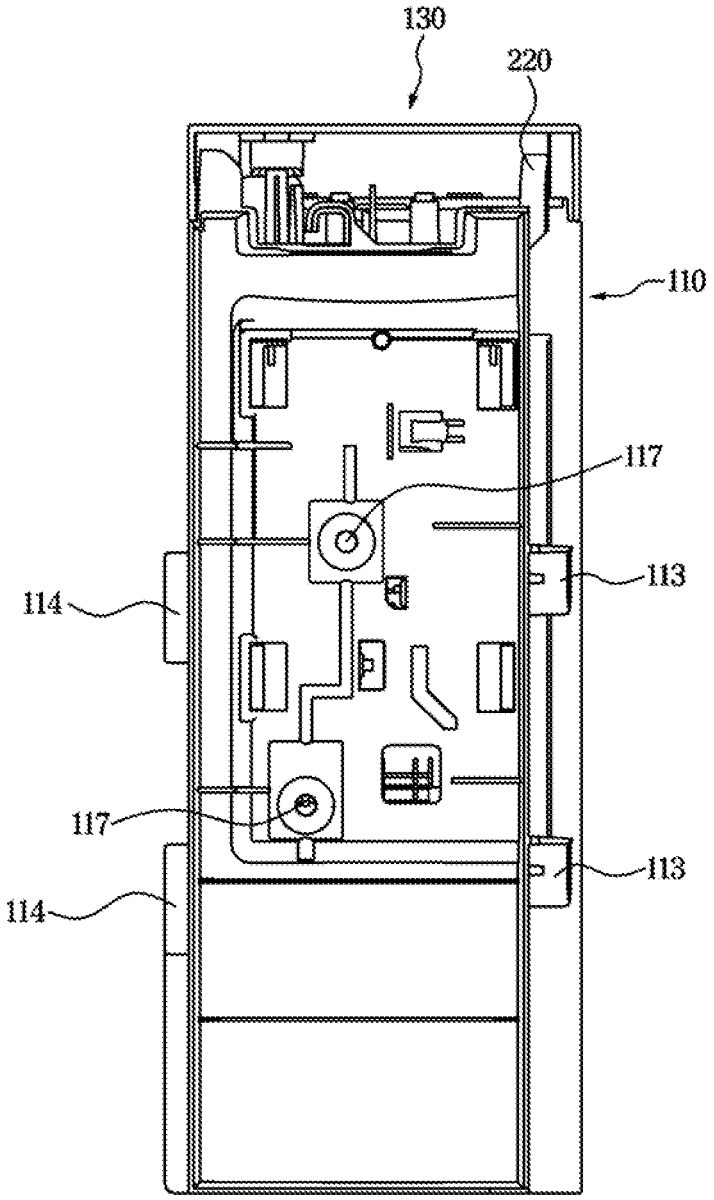
FIG. 17 is a rear view of a dispenser of a refrigerator according to an embodiment of the present disclosure.

FIG. 17 is a rear view of a dispenser of a refrigerator according to an embodiment of the present disclosure.

Referring to FIG. 17, the fixing ribs 113 for temporarily fixing the case 110 to the door 21 may be formed on one side surface of the case 110 at different heights, and the support ribs 114 for mounting the door guard 60 may be formed on the other side surface of the case 110 opposite thereto at different heights.

In the case where the door guard 60 is coupled to the support rib 114 of the case 110 as shown in FIG. 16, a torque to rotate the case 110 forward may be generated due to the center of gravity of the door guard 60.

Therefore, the fixing ribs 113 formed at one side surface of the case 110 may be provided at approximately same heights as the support ribs 114 formed on the other side surface to support the case 110 against the rotational force caused by the door guard 60.

In addition, the fastening member is coupled thereto to offset the rotational force through the first fastening member coupler 117 extending backward from the front surface 115 of the case 110. In addition, the fastening member may be coupled to the side of the case 110 through the second fastening member coupler 220. Thereby, a structure capable of compensating for the weight may be provided even when a heavy article is stored in the door guard 60.

Figure 18:
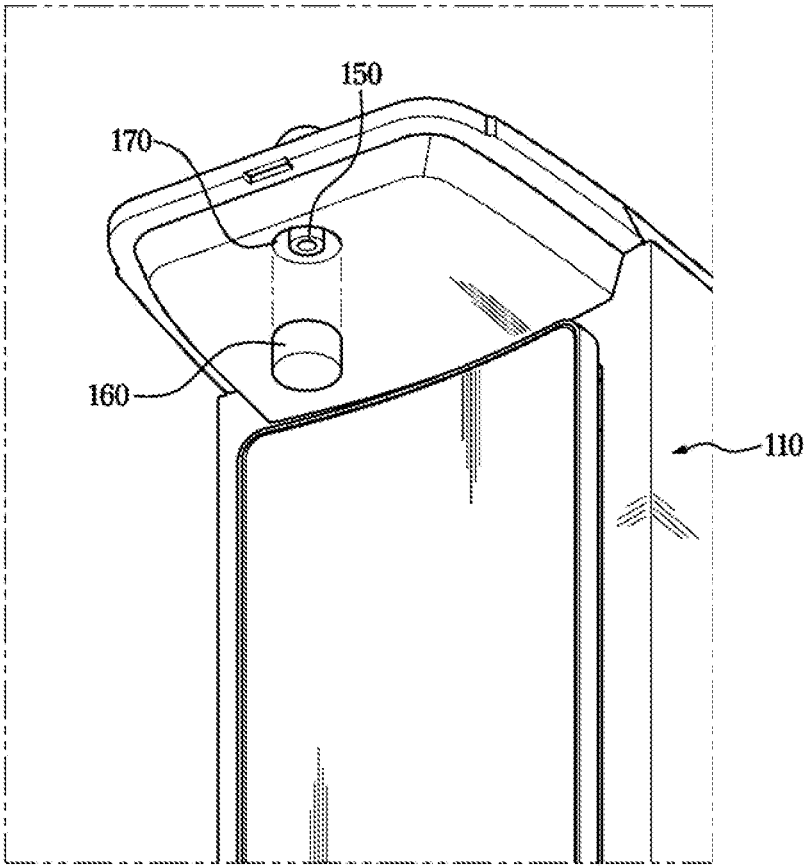
FIG. 18 is a view illustrating a water outlet hole 170 and a stopper of a refrigerator according to an embodiment of the present disclosure.
Figure 19:
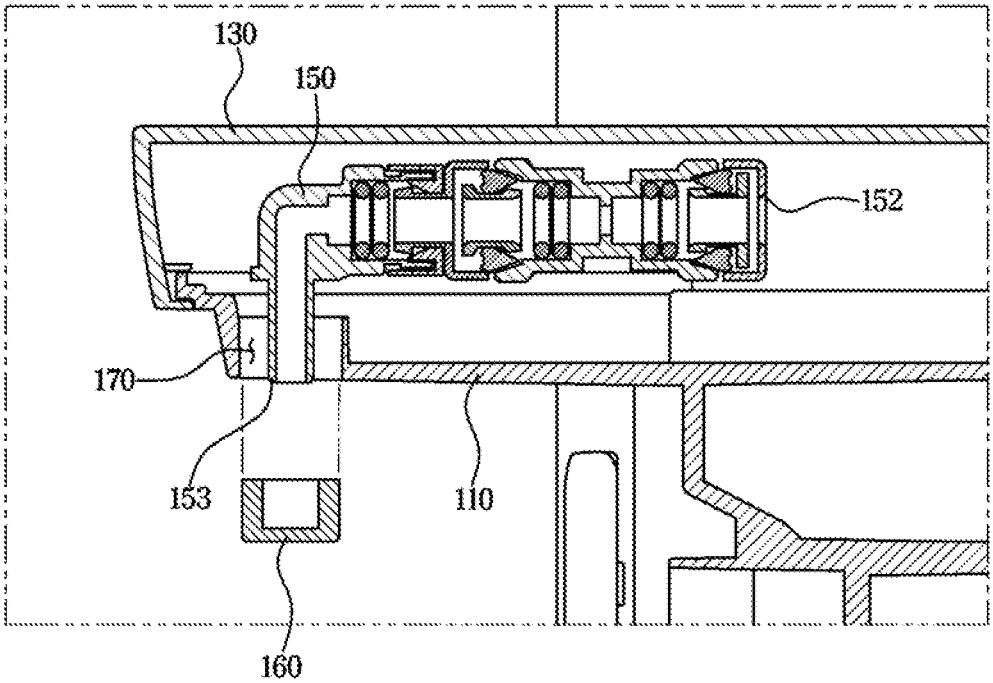
FIG. 19 is a cross-sectional view illustrating a case coupled to a fitting member and a stopper in a dispenser according to an embodiment of the present disclosure.

FIG. 18 is a view illustrating a water outlet hole 170 and a stopper of a refrigerator according to an embodiment of the present disclosure. FIG. 19 is a cross-sectional view illustrating coupling of a case, a fitting member, and a stopper in a dispenser of a refrigerator according to an embodiment of the present disclosure.

Referring to FIGS. 18 and 19, the case 110 may include a water outlet hole 170 through which the fitting member 150 passes. The water outlet hole 170 may be provided at the front end of the case 110.

The dispenser 100 may include a stopper 160 provided to be detachable from the dispenser 100 to close one end of the fitting member 150.

The fitting member 150 may include a hose connector 152 connected to a hose constituting the second water supply flow path 56 and a water outlet 153 through which water flows out. The water outlet 153 may be inserted into the water outlet hole 170 and exposed to the outside.

The water outlet hole 170 may be formed to be spaced apart from the fitting member 150 such that the stopper 160 is coupled thereto. The water outlet hole 170 may be formed at a lower portion of the front end of the case 110.

Specifically, the stopper 160 may be used for process inspection of the internal water supply line of the refrigerator 1.

First, the stopper 160 is inserted into the water outlet hole 170 to close the water outlet 153 of the fitting member 150, and then a time taken to reach a predetermined level of pressure after water flows in a forward direction.

In the case where the measured time to reach the predetermined level of pressure is longer than a reference time, it may be determined that there is a factor of clogging the internal water supply line. Continuously, in the case where the pressure is not maintained but decreases in a state where the water outlet 153 of the fitting member 150 is closed by the stopper 160, it may be determined that there is leakage in the internal water supply line.

Therefore, clogging and leakage of the internal water supply line of the refrigerator 1 may be checked by attaching and detaching the stopper 160 that blocks the water outlet 153 of the fitting member 150 without mounting a separate member therein.

The embodiments of the present disclosure have been shown and described above with reference to the accompanying drawings. However, the disclosed embodiments are illustrative and the scope of the present disclosure is not limited thereby. It will be understood by those of ordinary skill in the art that the present disclosure may be easily modified into other detailed forms without changing the technical principle or essential features of the present disclosure.

What is claimed is:

1. A refrigerator comprising:

a storage compartment;

a door to open and close the storage compartment;

a storage tank in the storage compartment, the storage tank being provided to store water supplied from an external water supply line;

a dispenser, having a case connectable to the storage tank, to discharge the water stored in the storage tank while the case is connected to the storage tank, the dispenser being attachable to and detachable from a rear surface of the door facing the storage compartment; and a container to store an item therein, the container being attachable on and detachable from the rear surface of the door, wherein the door comprises:

a pair of guides formed at a same height with respect to each other on an inner side of the rear surface of the door; and a guide groove formed between the pair of guides, wherein the case comprises:

a fixing rib extending outward from one side surface of the case and coupleable to and decouplable from the guide groove in a vertical direction, a support rib extending outward from the case, wherein the container comprises at least one guard fixing rib protruding from both side surfaces of the container, and the at least one guard fixing rib is coupled to the support rib formed at the case while the container is attached to the rear surface of the door, wherein the one side surface of the case is a first side surface, and the support rib protrudes outward from a second side surface of the case opposite to the first side surface, wherein the support rib is among a plurality of support ribs formed on the case provided at different heights and the container is mountable at the different heights.

2. The refrigerator according to claim 1, wherein the fixing rib comprises:

an insertion section to be fitted in the guide groove; and a holder mountable on a top surface of the guide groove defined by the pair of guides.

3. The refrigerator according to claim 1, wherein the dispenser further comprises a lever coupleable to the case, and the case comprises:

a lever mount recessed from a front surface to seat the lever; and a fastening member coupler which extends backward from the lever mount.

4. The refrigerator according to claim 3, wherein the fastening member coupler is covered by the lever.

5. The refrigerator according to claim 4, wherein the fastening member coupler is a first fastening member coupler, and the case further comprises a second fastening member coupler which extends upward along a direction different from the first fastening member coupler.

6. The refrigerator according to claim 1, wherein the case further comprises an upper portion including a space to accommodate parts.

7. The refrigerator according to claim 6, wherein the dispenser further comprises a cover provided to cover the upper portion of the case, and the cover is guided to a coupling position via a projection which extends upward in the upper portion of the case.

8. The refrigerator according to claim 7, wherein the cover comprises a guide protrusion provided at a front end, and the upper portion of the case further accommodates a protrusion insertion region into which the guide protrusion is insertable while the cover is coupled.

9. The refrigerator according to claim 6, wherein the upper portion of the case comprises a water outlet hole formed to discharge water.

10. The refrigerator according to claim 1, wherein the dispenser comprises:

a vessel support which extends forward from a lower portion of a front surface of the case; and a dispensing space to accommodate a vessel placed on the vessel support to receive water.

* * * * *